US006812394B2

(12) United States Patent
Weissflog

(10) Patent No.: US 6,812,394 B2
(45) Date of Patent: Nov. 2, 2004

(54) METHOD AND DEVICE FOR DETERMINING RHYTHM UNITS IN A MUSICAL PIECE

(75) Inventor: Jörg Weissflog, Willich (DE)

(73) Assignee: Red Chip Company, Tortola (VG)

( * ) Notice: Subject to any disclaimer, the term of this patent is extended or adjusted under 35 U.S.C. 154(b) by 0 days.

(21) Appl. No.: 10/202,328

(22) Filed: Jul. 24, 2002

(65) Prior Publication Data

US 2003/0221544 A1 Dec. 4, 2003

(30) Foreign Application Priority Data

May 28, 2002 (DE) ..... 102 23 735

(51) Int. Cl.[7] ..... G10H 1/40; G10H 5/00
(52) U.S. Cl. ..... 84/667; 84/668; 84/484
(58) Field of Search ..... 84/667, 603, 611, 84/636, 652, 661, 668, 714, 675–677, 484, DIG. 11, DIG. 12

(56) References Cited

U.S. PATENT DOCUMENTS 5,614,687 A * 3/1997 Yamada et al. ..... 84/662
6,323,412 B1 * 11/2001 Loo ..... 84/636

* cited by examiner

*Primary Examiner*—Jeffrey W Donels
(74) *Attorney, Agent, or Firm*—Collard & Roe, P.C.

(57) ABSTRACT

A method for determining rhythm units (beats per minute or BPM) in (digital) audio data forming a musical piece. The audio data is split among a plurality of determination paths wherein it is subdivided into predetermined frequency bands. The data is analyzed for transients in order to determine attack events. In addition, the time intervals between two successive attack events are measured. In this case, the time intervals are averaged and defined as the frequency-band-specific rhythm unit (BPM) of the audio data in the respective determination path. Thus, the rhythm unit which exhibits the highest beat number (BPM number) is selected from the frequency-band-specific rhythm units (BPM) of the determination paths.

14 Claims, 4 Drawing Sheets

METHOD AND DEVICE FOR DETERMINING RHYTHM UNITS IN A MUSICAL PIECE

BACKGROUND OF THE INVENTION

Field of the Invention

The present invention relates to a device for determining rhythm units in a musical piece, and it also relates to a method and a device for determining rhythm units in musical pieces on the basis of digital audio data.

Devices for determining rhythm units in a musical piece actually determine the beats per minute in a musical piece or the tempo of the musical piece, and are also known as BPM detectors (where BPM stands for beats per minute). Such devices are used in the most diverse sectors of the music business. Disk jockeys may wish to measure the tempo of two different music sources to be able to coordinate their tempos. In MIDI applications, the BPM detector is used to synchronize the speed of a MIDI event sequencer with an existing audio track. In a music database system, it is possible, for example, to characterize music by rhythm units and to assign it indices based on its BPM value.

Thus, real-time implementations of devices for determining rhythm units have usually been based on the principles of autocorrelation and on the principles of a variable threshold.

Unfortunately, these two principles cannot determine beats greater than 5 to 6 rhythm units (BPM).

One object of the present invention is to provide a method for determining rhythm units in digital audio data and a device for performing the method, to ensure faster determination than in the past, together with high determination accuracy.

SUMMARY OF THE INVENTION

The invention relates to a method and a device that permits a determination accuracy of up to ±0.1 rhythm units (BPM) after a measurement time of just three periods and a speed of 3 rhythm units (BPM). When the inventive method and the inventive device are used for disk jockey applications, the range of rhythm periods to be measured preferably corresponds to 60 to 160 rhythm units (BPM).

More specifically, the invention relates to a device having a plurality of parallel processing blocks or determination paths, through all of which the digital or digitized audio signal passes. At the output of the parallel determination paths, a logic circuit selects that determined value of rhythm units which represents the most plausible measurement, and this determination result is preferably indicated optically on a suitable display.

More specifically, each determination path monitors a very narrow frequency band, which is obtained from the total frequency band of the audio data by bandpass filters. A transient detector is connected downstream from the respective bandpass filter and is used to check the attack events for transients. The time interval occurring between two successive attack events (transients) is measured and analyzed by a periodicity detector, whereupon an averaged resultant BPM value is displayed.

More specifically, the invention provides, a method for determining rhythm units (BPM) in (digital) audio data. This audio data is split among a plurality of determination paths, a) wherein this data is subdivided into predetermined frequency bands, b) wherein the data is analyzed for transients to determine attack events, c) wherein the time intervals between two successive attack events are measured, d) wherein the time intervals are averaged and defined as the frequency-band-specific rhythm unit (BPM) of the audio data in the respective determination path, and wherein that rhythm unit which exhibits the highest beat number (BPM number) which is selected from the frequency-band-specific rhythm units (BPM) of the determination paths.

As already mentioned herein above, the determined rhythm unit (BPM) is preferably indicated optically.

The frequency bands for step a) are preferably extremely narrow or are selected with high Q.

Since the center frequency of the instruments that set the rhythm unit in musical pieces lies at a very high and/or a very low end of the audio frequency spectrum, the frequency bands of the individual determination paths are selected accordingly.

To measure the transients in step b), the maximum average energy of the audio signal in the frequency band of the respective determination path is determined as a function of time $t_w$. Thus, the amplitude of the audio signal in a time window of predetermined length is squared and averaged for determination of its energy in the frequency band of the respective determination path. Preferably, the time window is a rectangular integration window. The squared amplitude of the audio data is preferably delayed by a delay element, and subtracted from the input signal of the delay line and summed using a further delay element, to obtain the rectangular integration window that measures the average energy in the frequency band as a function of time $t_w$. To ensure an overlapping sequence of successive time windows, the time windows of successive energy-determination values are preferably scaled with a constant factor c and output with constant time intervals $t_s$ ($t_s<t_w$).

From the determined energy values, a local maximum is preferably calculated. For this calculation a linear regression is used to determine the maximum average energy of the audio data. As the local maximum, there is calculated an energy value which is larger than a defined number of preceding energy values and a defined number of subsequent energy values. In addition, for the local maximum, the energy value in question must be larger than a minimum energy level or a separately determined threshold value.

Since the rhythm unit determined in the individual determination paths as explained herein above can also be, one quarter or one half or double the sought rhythm unit, the determined rhythm unit is restored to a basic rhythm unit by scaling as disclosed in step d), hereinabove. Thus, no multiple of the basic rhythm unit is output as the rhythm-unit determination result.

The present invention provides a device for determining the rhythm unit (BPM) in digital audio data by performing the inventive method, the device has an input to which the audio data is applied and with an output at which the determined rhythm unit is output. The determination device has a plurality of rhythm-unit detectors (BPM detectors), which are connected in parallel between the input and a logic circuit upstream from the output. The rhythm-unit detectors comprises a plurality of components:

These components can include a bandpass filter for separating a frequency range from the audio signal present at the input. The bandpass filters of the rhythm-unit detectors cover at least part of the total bandwidth of the audio signal. There is also a transient detector for determining attack events and a timer for measuring the time intervals between two successive attack events. There is also a periodicity detector for averaging the time intervals and defining the averaged time intervals as a frequency-band-specific rhythm unit (BPM) of the audio data in the respective determination path. In this case, the logic circuit is designed to select from the frequency-band-specific rhythm units (BPM) of the determination paths that which has the highest beat number (BPM number).

For optical indication of the determined rhythm unit (BPM), a display device is preferably connected downstream from the logic circuit.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
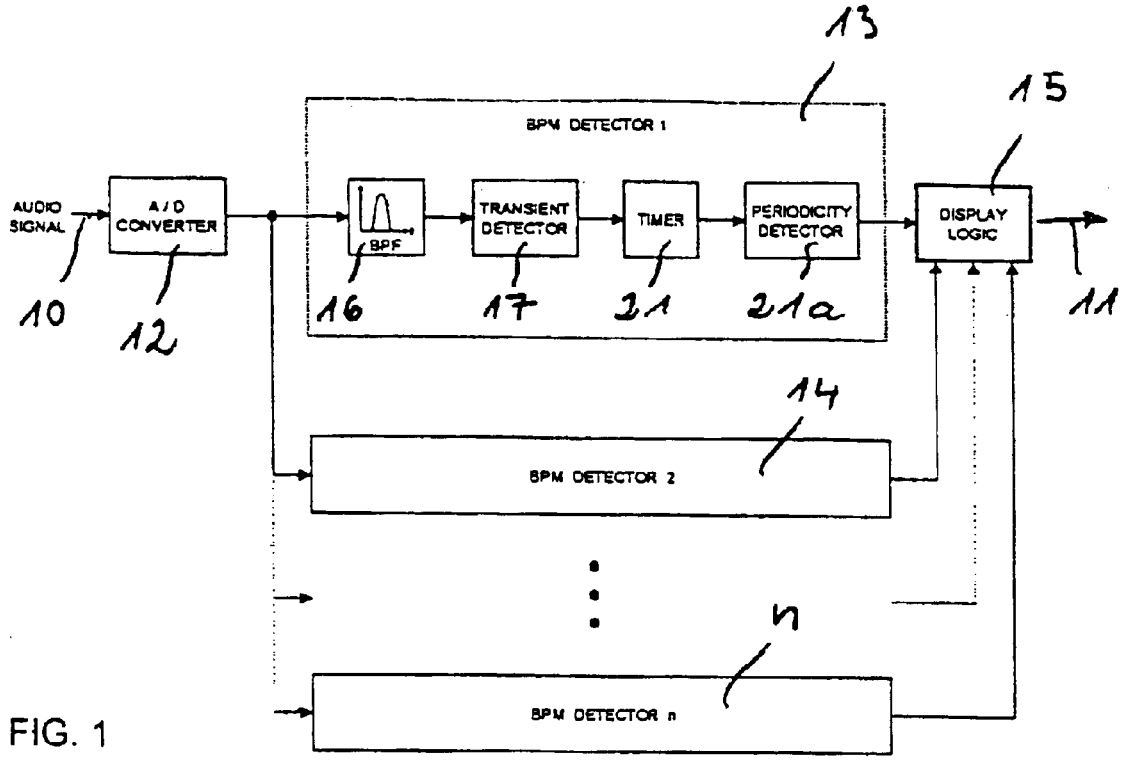
FIG. 1 is a schematic block diagram of the inventive device.

FIG. 1 shows the embodiment of a device for determining rhythm units (BPM) in a musical piece. The device has an input 10 and an output 11. There is also an analog/digital converter coupled to an audio input immediately downstream for reading (A/D) analog signals and converting them to digital signals. The digital audio data present at the output of the analog-to-digital converter is injected into a plurality of rhythm-unit detectors connected in parallel, namely into rhythm unit detectors 13, 14, . . . n. The output signals of rhythm-unit detectors 13, 14, . . . n, are injected into a corresponding number of inputs of a logic circuit 15 or display logic, whose output is connected to output 11 of the device.

The construction of rhythm-unit detectors 13, 14, . . . n will be explained hereinafter, using as an example the construction of detector 13, which is chosen as representative of the other detectors, which basically have the same construction.

A bandpass filter 16 is disposed at the input of detector 13. This bandpass filter has a very narrow bandwidth or a very high Q. The center frequencies of the bandpass filters of the various rhythm-unit detectors 13, 14, . . . n are chosen so that they are different from one another and, in particular, cover a known band region of the digital audio data. The center frequencies of the respective bandpass filters are preferably located in the very high and very low frequency range of the audio spectrum, to monitor typical rhythm instruments, such as bass drums and Hi-Hats.

The output signal of bandpass filter 16 is injected into a transient detector 17, which is used to analyze attack events for transients, and determine rhythm units from the filtered digital audio data. This transient detector contains a window integrator 18, which is shown schematically in FIG. 2, a threshold circuit 19, which is shown in FIG. 3, a detector for determining a local energy maximum, which is shown schematically in FIG. 4 and is denoted as a whole by reference symbol 20, and a linear regression means, whose function is shown in the form of a diagram in FIG. 5. The transient detector also cooperates with a timer 21.

Transient detector 17 will now be explained in more detail for reconstruction of its components in connection with timer 21.

To determine transients of the bandpass-filtered audio signal (of the digital audio data, hereinafter also referred to as the audio signal), the audio signal is squared and averaged over time via a time window of length $t_w$. To minimize computing load, a time window is selected in the form of a rectangular analysis window or integration window. This permits the use of a very simple window-generation method, shown in greater detail in FIG. 2.

Figure 2:
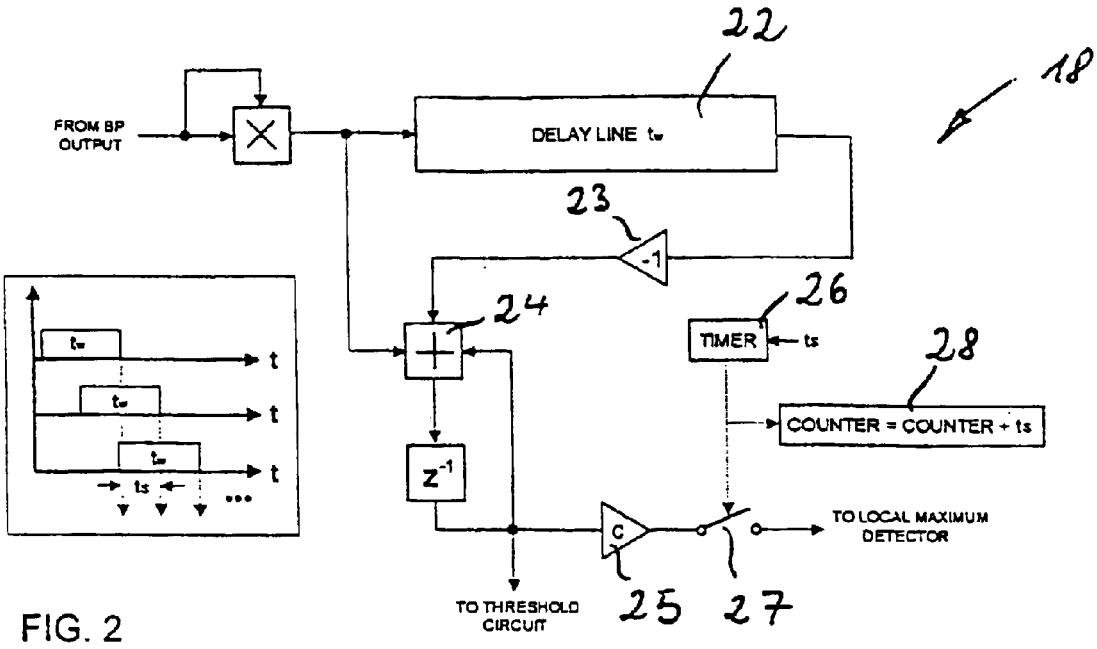
FIG. 2 is a schematic block diagram of a window integrator of the transient detector of one of the rhythm-unit detectors in the device shown in FIG. 1.
Figure 3:
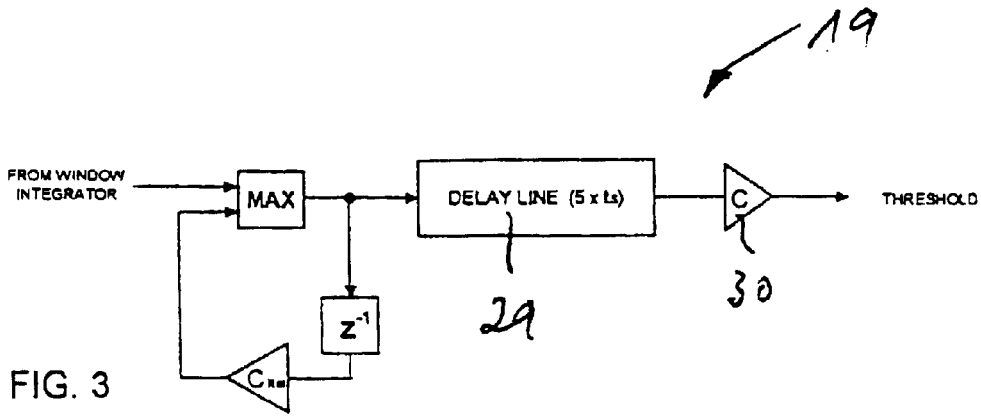
FIG. 3 is a schematic block diagram of a threshold circuit of the transient detector for the transient detector of one of the rhythm-unit detectors in the device shown in FIG. 1.

FIG. 2 shows that the squared audio signal is injected into a delay line 22. On the output side of delay line 22, there are connected a NOT element 23 and a summing element 24, to the input side wherein the input signal is also applied in delay line 22. As a result, the output signal of the delay line is subtracted from the input signal of the delay line, and this subtraction result is summed using a further delay element, which is not shown in greater detail. The result is a rectangular integration window, which measures the average energy of the audio signal in the frequency band as a function of time $t_w$. A corresponding timing diagram is shown in the bottom left portion of FIG. 2.

The measured energy values are scaled with a constant factor "c" in a scaler 25 and are output with constant time intervals $t_s$, which are generated using a clock generator 26, which actuates a switch 27 and whose output signal is also connected to a counter 28. To ensure overlapping of windows, $t_s$ should be made shorter than $t_w$ (for example, $t_s=0.5\times t_w$).

The clock generator also progressively increments time counter 28 by $t_s$, to apply, as explained hereinafter, a signal to local maximum detector 20 connected downstream.

The signal input into scaler 25 is also injected into threshold circuit 19, which is shown schematically in FIG. 3 and which will now be explained in more detail.

To monitor the average energy level of the frequency band, a peak-value-holding circuit is used. This peak-value circuit, which is shown in FIG. 2, has a construction known in itself. Threshold circuit 19, which is designed as the peak-value-holding circuit, ensures that the output signal of the circuit is delayed by $5\times t_s$ in open delay line 29 and, in a scaling circuit 30, is scaled by the constant factor "c", for which a value smaller than 1.0 is chosen.

Figure 4:
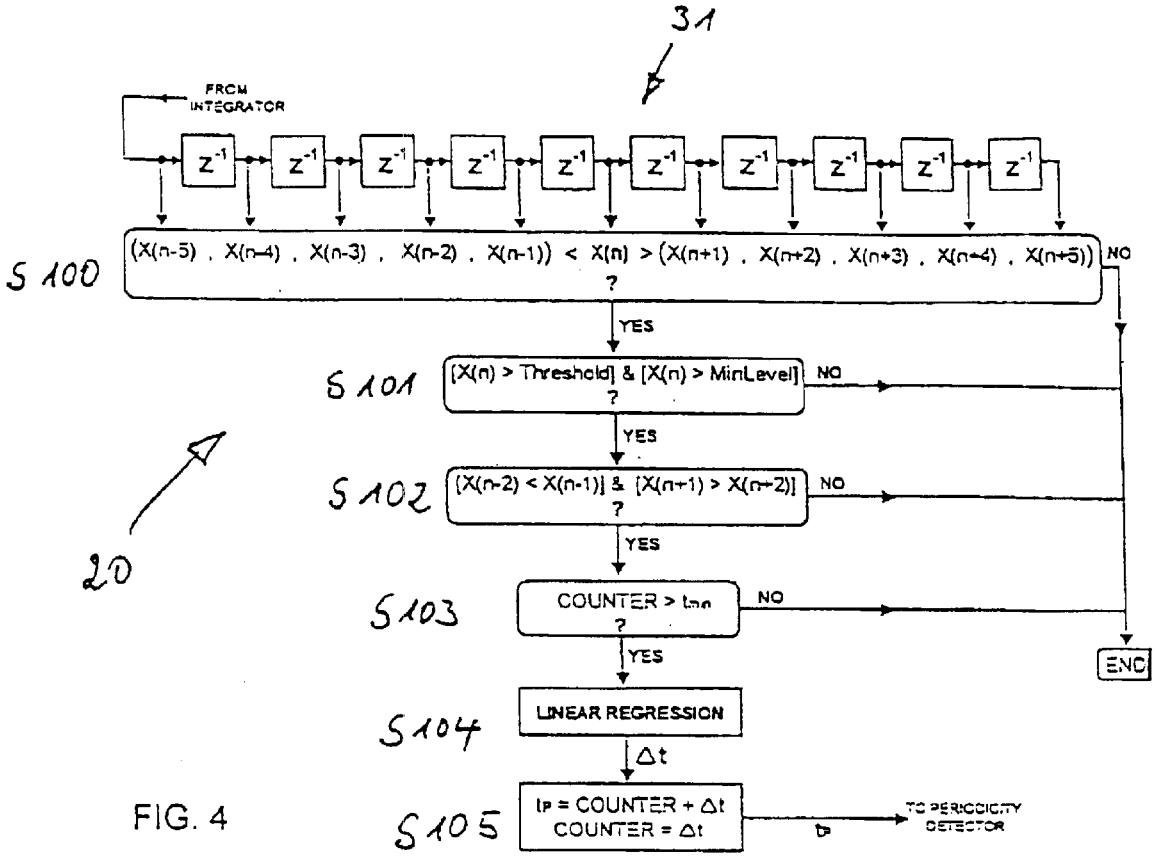
FIG. 4 is a schematic block diagram of a detector for determining a local maximum of the transient detector of one of the rhythm-unit detectors of the device of FIG. 1.

FIG. 4 shows the local maximum detector 20. The output signal of window integrator 18 is applied to the input of local maximum detector 20. In particular, the output signal of the window integrator is injected into a delay line 31, which comprises a total of ten nested individual delay elements, each denoted by $z^{-1}$. The output signal of the fifth delay element is denoted by X(n), and it is assumed that it represents the local maximum. First, the measured energy X(n) is verified as to whether it is higher than the five preceding energy values and lower than the five subsequent energy values (step S100). In the next step S 102, X(n) is checked as to whether it exceeds the threshold generated in threshold circuit 19 of FIG. 3. To avoid measurement of the BPM or rhythm unit when no audio signal is present, X(n) is verified as to whether it exceeds a defined minimum energy level MinLevel.

Since a linear regression is applied later in subsequent step S 104, the two previously measured and the two subsequently measured energy values X(n) should satisfy the following two conditions:

$$X(n-2)<X(n-1)$$

and $$X(n+1)>X(n+2).$$

Assuming in the music signal that some percussion instruments can generate, transients with factors of 2 or 4 times the actual BPM value, the minimum time interval is taken as 90 ms in the present example. Thus, all local maxima that occur in a time interval of 90 ms starting from the previously determined transient are ignored (step S 103: counter>$t_{min}$).

Figure 5:
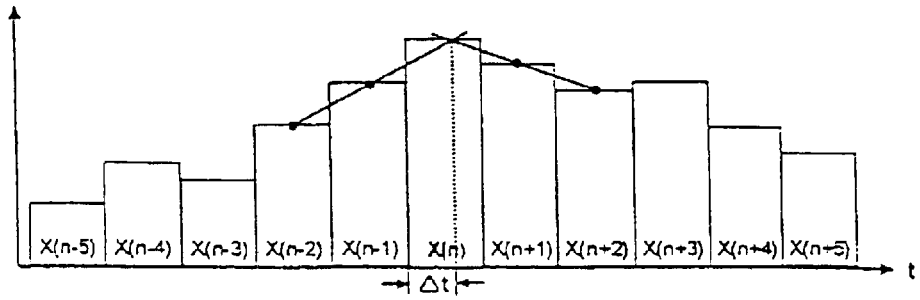
FIG. 5 shows a diagram of a linear regression applied in the transient detector of one of the rhythm-unit detectors of the device of FIG. 1.

Step S 103 is followed by step S 104, wherein there is a linear regression, an example of which is shown in the form of a diagram in FIG. 5.

Since the existence of local maxima is sampled only in time intervals of length $t_s$, it is obvious that the location of a local maximum can be determined only with a precision of $\pm 0.5 \times t_s$, because the time counter is also implemented in steps of $t_s$. To achieve more precise location of the local maximum, therefore, a four-point linear regression is calculated using the two previously measured and the two subsequently measured energy values Xn, as shown in FIG. 5.

As is evident from FIG. 1, transient detector 17 is followed by a timer 21.

In timer 21, a calculated time value At is added to the value of the time counter. The resulting value is relayed to periodicity detector 13.

Figure 6:
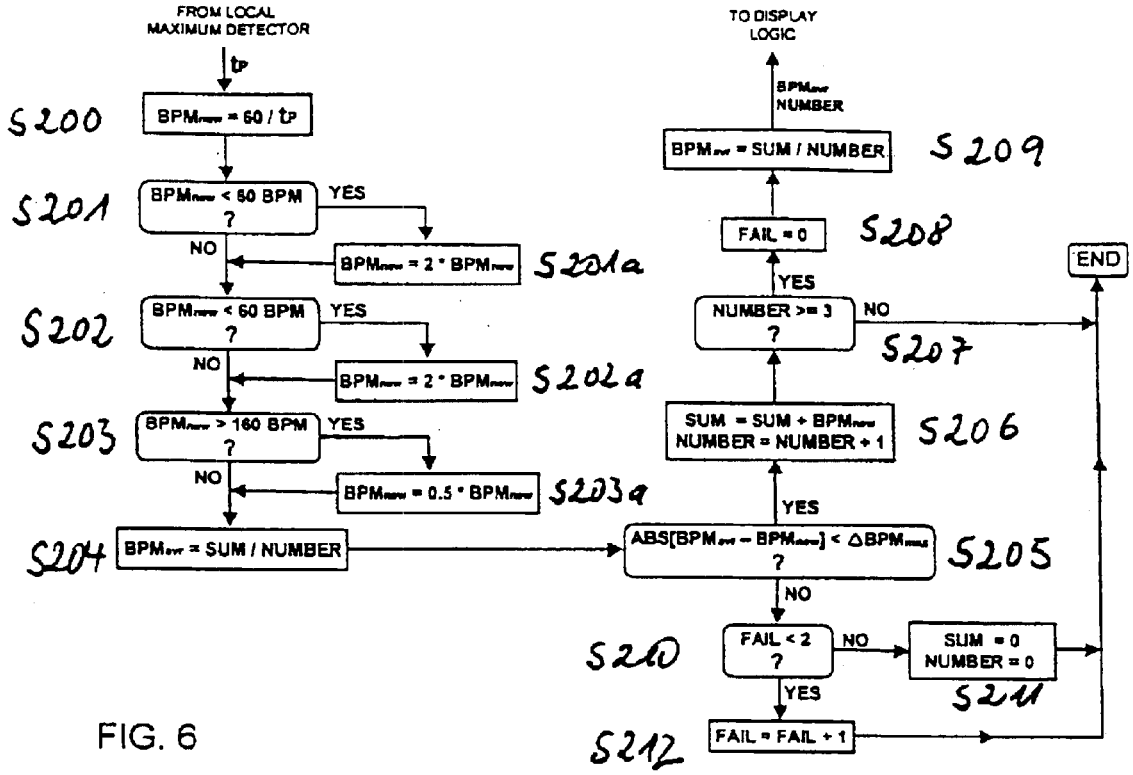
FIG. 6 shows a periodicity detector of one of the rhythm-unit detectors of the device of FIG. 1 in the form of a flow diagram.
Figure 7:
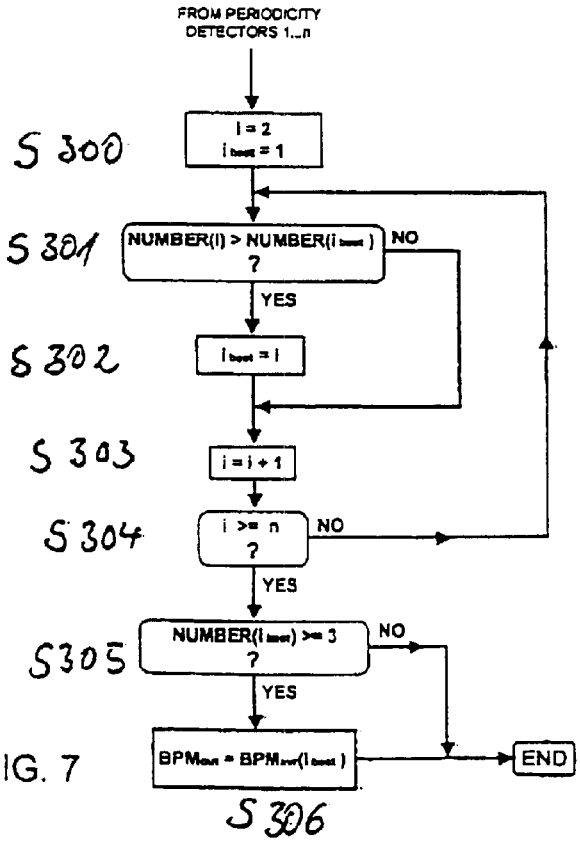
FIG. 7 shows schematically a flow diagram, showing the function of the logic circuit of the device of FIG. 1.

FIG. 6 shows the function of periodicity detector 21*a* in the form of a flow diagram. In step S 200 therein, the measured time interval $t_p$ is first converted to a rhythm-unit or BPM value. Under the assumption that the measured time interval could result from a rhythm unit equal to a multiple of ½, ¼ or 2, the actual BPM value of the analyzed musical piece is restored to the basic rhythm unit since, in the present embodiment, the inventive device is used only to determine BPM values in the range of 60 to 160 BPM, and it is therefore assumed that BPM values below or above this range are possible multiples of the actual BPM value. For this reason, the current value $BPM_{new}$ is scaled with the factor 2, 4 or 0.5, to restore this factor to the basic factor (step S 201*a*, step S 202*a* and step S 203*a*).

Thereafter the average value $BPM_{avr}$ of the previously measured BPM values is calculated by dividing the BPM summing element value "SUM" by the number of summed BPM values (NUMBER) and compared with the new measured value $BPM_{new}$. When the difference lies within a limit of $\Delta BPM_{max}$, $BPM_{new}$ is added to "SUM" and "NUMBER" is incremented by 1. If, in addition, "NUMBER" is greater than or equal to 3, an error flag "FAIL" is canceled and a new $BPM_{avr}$ value is calculated and relayed to the output of periodicity detector 13. In contrast, if the difference between $BPM_{new}$ and $BPM_{avr}$ is larger than $\Delta BPM_{max}$, the new measurement is regarded as erroneous. If error flag "FAIL" had already been set beforehand, "SUM" and "NUMBER" are "reinitialized" with "0". Otherwise error flag "FAIL" is set.

The output signal of periodicity detector 21*a* is relayed to logic circuit 15, at whose other inputs the output signals of the periodicity detectors of the further BPM detectors 13, 14, . . . n are present. The functional principle of logic circuit 15 is illustrated in FIG. 6 in the form of a flow diagram.

Accordingly, whenever a new rhythm unit or BPM value is measured and injected into periodicity detector 21*a*, the most plausible measured BPM value is determined by a rhythm-unit counter. For all n BPM detectors 13, 14, . . . n, the $BPM_{avr}$ value of that BPM detector with the higher "NUMBER" value is selected, relayed to the output of logic circuit 15 and optically indicated on a display device, when at least three continuous rhythm units have been determined.

Accordingly, while at least one embodiment of the present invention has been shown and described, it is to be understood that many changes and modifications may be made thereunto without departing from the spirit and scope of the invention as defined in the appended claims.

What is claimed is:

1. A method for determining rhythm units in digital audio data forming a musical piece, wherein the audio data is split among a plurality of determination paths, the method comprising the steps of:

a) subdividing the rhythm units into a plurality of predetermined frequency bands that are extremely narrow and that are at only a very high end or a very low end of an audio frequency spectrum;

b) analyzing the rhythm units for at least one transient to determine a plurality of attack events;

c) measuring a time between two successive attack events; and d) averaging a plurality of time intervals defined as frequency-band-specific rhythm unit (BPM) of the audio data in respective determination paths wherein a rhythm unit which exhibits a highest beat per minute number (BPM number) is selected from the frequency-band specific rhythm units (BPM) of the determination path.

2. The method as in claim 1, wherein the determined rhythm unit is indicated optically.

3. The method as in claim 1, further comprising the step of determining a maximum average energy of an audio signal in the frequency band of the respective determination path which is determined as a function of time (tw).

4. A device for determining the rhythm units in digital audio data including an input to which audio data is applied, an output, at which a rhythm unit is output and also a plurality of rhythm unit detectors which are connected in parallel between the input and a logic circuit disposed upstream from the output, the detectors comprising the following components:

a) a bandpass filter for separating a frequency range from the audio signal present at the input, said bandpass filters covering at least part of the total bandwidth signal;

b) a transient detector in communication with said bandpass filter said transient detector for determining attack events;

c) a timer for measuring the time intervals between two successive attack events; and d) a periodicity detector for averaging the time intervals and defining the averaged time interval as a frequency band specific-rhythm unit (BPM) of the audio data in a determination path of said rhythm unit detectors, wherein the logic circuit is designed to select from the frequency band specific rhythm units of the determination paths that rhythm unit (BPM) which has the highest beat number.

5. The device as in claim 4, further comprising a display device coupled downstream from said logic circuit for indicating the determined rhythm unit.

6. A method for determining rhythm units in digital audio data forming a musical piece, wherein the audio data is split among a plurality of determination paths, the method comprising the steps of:

a) subdividing the rhythm units into a plurality of predetermined frequency bands;

b) analyzing the rhythm units for least one transient to determine a plurality of attack events;

c) measuring a time between two successive attack events;

d) averaging a plurality of time intervals defined as frequency-band-specific rhythm unit (BPM) of the audio data in respective determination paths wherein a rhythm units which exhibits a highest beat per minute number (BPM number) is selected from the frequency-band specific rhythm (BPM) of the determination path; and determining a maximum average energy of an audio signal in the frequency band of the respective determination path which is determined as a function of time (tw).

7. The method as in claim 5, wherein said step of determining a maximum average energy of an audio signal includes squaring and averaging an amplitude of an audio signal to determine its energy in the frequency band of the respective determination path.

8. The method as in claim 7, wherein said time window is a rectangular integration window.

9. The method as in claim 7, further comprising the step of delaying said squared amplitude of the audio signal via a delay element, wherein said delay element is subtracted from the input signal of the delay line and summed using a further delay element.

10. The method as in claim 9, further comprising the step of overlapping successive time windows of successive energy determination values by sealing with a constant factor c and then outputting with constant time intervals ts (ts<tw).

11. The method as in claim 7, further comprising the steps of calculating a local maximum from said determined energy values; and applying a linear regression for determining a maximum average of the audio signal.

12. The method as in claim 11, wherein said step of calculating a local maximum includes calculating it as an energy value which is larger than a defined number of subsequent energy values.

13. The method as in claim 12, wherein said step of calculating a local maximum includes determining whether the energy value is larger than a minimum energy level or a separately determined threshold value.

14. The method according to claim 13, further comprising the step of scaling said rhythm unit to ensure that it does not represent a multiple of a basic rhythm unit.

* * * * *

UNITED STATES PATENT AND TRADEMARK OFFICE

CERTIFICATE OF CORRECTION

PATENT NO. : 6,812,394 B2
DATED : November 2, 2004
INVENTOR(S) : Weissflog

It is certified that error appears in the above-identified patent and that said Letters Patent is hereby corrected as shown below:

Title page,
Item [73], Assignee, should correctly read -- Red Chip Company, Ltd. --.

Signed and Sealed this

Tenth Day of May, 2005

JON W. DUDAS
*Director of the United States Patent and Trademark Office*